US006295933B1

(12) United States Patent
Dubocage et al.

(10) Patent No.: US 6,295,933 B1
(45) Date of Patent: Oct. 2, 2001

(54) NON-LETHAL PROJECTILE FOR FIREARMS

(75) Inventors: Bernard Dubocage, Les Ecrennes; Jacques Maucourt, Vert-le-Petit, both of (FR)

(73) Assignee: SNPE, Paris Cedex (FR)

( * ) Notice: Subject to any disclaimer, the term of this patent is extended or adjusted under 35 U.S.C. 154(b) by 0 days.

(21) Appl. No.: 09/429,376

(22) Filed: Oct. 28, 1999

(30) Foreign Application Priority Data

Dec. 10, 1998 (FR) ..... 98 15603

(51) Int. Cl.[7] ..... F42B 10/00

(52) U.S. Cl. ..... 102/439; 102/444; 102/501; 102/502; 102/529

(58) Field of Search ..... 102/444, 501, 102/502, 529

(56) References Cited

U.S. PATENT DOCUMENTS

| | | | | |
|---|---|---|---|---|
| 3,299,174 | * | 1/1967 | Kuhre | 260/876 |
| 3,749,016 | | 7/1973 | Hershikowitz | 102/517 |
| 3,952,662 | * | 4/1976 | Greenlees | 102/92.7 |
| 4,048,765 | | 9/1977 | Samuelson | 451/59 |
| 4,949,645 | * | 8/1990 | Hayward et al. | 102/517 |
| 5,652,407 | | 7/1997 | Carbone | 102/438 |
| 5,786,416 | | 7/1998 | Gardner et al. | 524/440 |
| 6,101,949 | * | 8/2000 | Maucourt et al. | 102/517 |

FOREIGN PATENT DOCUMENTS

| | | | |
|---|---|---|---|
| 0103509 | 3/1984 | (EP) | F42B/5/02 |
| 0368612 | 5/1990 | (EP) | H01B/1/20 |
| 2532742 | 3/1984 | (FR) | F42B/7/02 |
| 1030080 | 5/1966 | (GB) | C08G/41/00 |
| 2192258 | 1/1988 | (GB) | F42B/11/36 |
| 92-00499 * | 1/1992 | (WO) | F42B/12/74 |

* cited by examiner

*Primary Examiner*—Charles T. Jordan
*Assistant Examiner*—Kimberly S Smith
(74) *Attorney, Agent, or Firm*—Bucknam and Archer

(57) ABSTRACT

The present invention relates to a non-lethal projectile for a firearm composed of a novel, soft and elastic, composite material comprising a polymeric organic matrix and a pulverulent metallic filler, with a relative density of between 4 and 22, dispersed in the polymeric matrix.

The composite material has a relative density of between 1.0 and 2.9 and a Shore A hardness of between 2 and 30.

The polymeric organic matrix is a crosslinked polybutadiene comprising polybutadiene chains with a mass of between 500 and 10,000 connected by bridges.

The projectile according to the invention makes it possible to neutralize an animal or a person without endangering his life and without inflicting serious injuries, even when firing at a short range of less than 5 m.

21 Claims, 1 Drawing Sheet

NON-LETHAL PROJECTILE FOR FIREARMS

The present invention relates to the general field of firearms.

It relates to a novel non-lethal projectile for firearm cartridges, in particular for handguns, used at short range and intended to neutralize or immobilize an animal, an attacker or a hostile person without endangering his life, for the purpose of maintaining order or of self-defense.

The present invention also relates to a process for obtaining such a projectile and to novel, soft and elastic, composite materials which can be used to form such a projectile.

The use, with the abovementioned goal, of plastic bullets has been known for a long time but they turn out to be too hard and often cause serious physical injuries with significant after-effects, sometimes even fatal after-effects, which is not desired when weapons of this type are used.

The use is also known of deformable projectiles made of rubber or of elastomer comprising a filler, in particular of thermoplastic elastomer of EPDM (ethylene-propylene-diene monomers), styrene-isoprene-styrene or styrene-butadiene-styrene type.

Patent Application GB 2,192,258 discloses, for example, a non-lethal round comprising a projectile made of synthetic polyisoprene.

Patent Application FR 2,532,742 discloses projectiles formed of a rubber bullet having a Shore A hardness of 40 to 55 and a diameter less than that of the bore of the barrel of the gun. This document teaches that it is essential to thus restrict the diameter of the bullet in order not to risk bursting or bulging the barrel of the gun. It also teaches that the range of hardness mentioned results from a compromise. The projectile must be sufficiently hard so as not to flatten out to an excessive degree inside the barrel, which would cause it to bulge or to burst, and the projectile must be sufficiently soft to neutralize the individual without seriously injuring him.

However, it turns out that, under certain conditions of use, in particular in close defense weapons, that is to say for short ranges, for example of less than 5 m, between the weapon and the target, the abovementioned projectiles known to a person skilled in the art are too hard and do not flatten out sufficiently on impact, which can here again result in serious injuries which can be fatal.

A person skilled in the art is therefore searching for novel elastomeric projectiles which do not have the abovementioned drawbacks and which do not result in any risk of serious injury to a living target when they are used in a close defense weapon, while ensuring the neutralization of the target for a sufficient period of time.

The present invention makes it possible to solve this problem.

A particular subject-matter of the invention is novel non-lethal projectiles for firearms having the desired abovementioned characteristics and furthermore exhibiting many other advantages.

The novel projectiles according to the invention are particularly soft, since they exhibit a Shore A hardness of between 2 and 30. They flatten out on the living target with the formation of a pancake, ensuring his temporary neutralization as a result of the shock created on impact but without inflicting serious injuries, even when fired at short range.

Furthermore, by virtue of the use of a novel, very specific, composite material in preparing the novel projectiles according to the invention, these projectiles have mechanical properties such:

that they do not result in any damage to the barrel of the gun, despite their very low hardness, even when they are used in the form of balls having a diameter identical to or greater than the diameter of the bore of the barrel, which runs counter to the teaching of the abovementioned state of the art, that they remain physically intact and retain their mechanical properties (low hardness, elasticity) until impact on the target and even during impact, that they can be used in cartridges devoid of wadding, by themselves ensuring leaktightness with respect to combustion gases from the propellent powder. In this particularly simple and economic configuration, the projectiles have a diameter equal to or greater than the diameter of the cartridge into which they can be forcibly inserted, that they possess an exceptional shape memory much better than that of the projectiles known until now. Projectiles according to the invention in the form of balls with a diameter of 13 mm, forcibly inserted into cartridges with a diameter of 9.6 mm and thus retained under stress at ambient temperature, return fully to their original spherical shape when they are released and their mechanical properties have remained intact.

The novel non-lethal projectiles for firearms according to the invention are composed of a soft and elastic composite material comprising a polymeric organic matrix and a pulverulent metallic filler dispersed in the polymeric matrix.

They are characterized in that:

the Shore A hardness of the composite material, determined according to the method well known to a person skilled in the art, is between 2 and 30, preferably between 10 and 25, the relative density of the composite material is between 1.0 and 2.9, preferably between 1.5 and 2.5, the relative density of the metallic filler is between 4 and 22, the polymeric organic matrix is a crosslinked polybutadiene comprising polybutadiene chains, that is to say chains with the general structure $-(C_4H_6)_x-$, x being an integer, which are connected by bridges, -he number-average molecular mass (Mn) of the polybutadiene chains being between 500 and 10,000, preferably between 1000 and 5000.

The crosslinked polybutadiene is preferably composed solely of polybutadiene chains which are connected by bridges.

All the ranges of values mentioned above, as well as those which will follow, should be understood as including the limits.

"Crosslinked" polybutadiene should be understood as meaning a polybutadiene with a three-dimensional structure, which polybutadiene is obtained by the establishment of bridges between polybutadiene chains $-(C_4H_6)_x-$, generally by thermosetting of a liquid or pasty composition comprising a liquid polybutadiene comprising reactive functional ends and a crosslinking agent for this polybutadiene.

It is particularly surprising that the composite material used according to the invention, which comprises a crosslinked polymeric matrix and a fairly high level of filler, can be so soft and elastic, softer and more elastic than the majority of known filler-comprising thermoplastic polymeric materials.

These soft and elastic, crosslinked polymeric composite materials, particularly suited to the preparation of non-lethal projectiles for firearms, are novel, to our knowledge.

According to a particularly preferred alternative form of the invention, the crosslinked polybutadiene is a polyurethane, that is to say that the polybutadiene chains are connected to the bridges by urethane functional groups.

Such a crosslinked polymer can be obtained by reaction of a polybutadiene comprising hydroxyl ends with a polyisocyanate crosslinking agent.

According to another alternative form, the crosslinked polybutadiene is a poly(ester-alcohol), the polybutadiene chains of which are connected to the bridges by ester-alcohol functional groups of formula

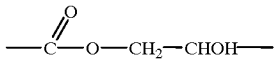

Such a crosslinked polymer can be obtained by reaction of a polybutadiene comprising carboxyl ends with a polyepoxide crosslinking agent.

According to another alternative form, the crosslinked polybutadiene is a poly(ester-amine), the polybutadiene chains of which are connected to the bridges by ester-amine functional groups of formula

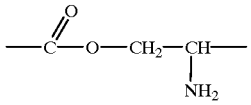

Such a crosslinked polymer can be obtained by reaction of a polybutadiene comprising carboxyl ends with a polyaziridine crosslinking agent.

According to a preferred alternative form of the invention, the crosslinked polybutadiene is plasticized. Mention may be made, as examples of plasticizers well known in the rubber industry, of dioctyl azelate, dioctyl sebacate and dioctyl phthalate.

According to another preferred alternative form of the invention, the crosslinked polybutadiene comprises one or more antioxidizing agents. Any antioxidizing agent well known to a person skilled in the art in the rubber industry is suitable. Mention may be made, for example, of phenols, such as di-tert-butyl-para-cresol.

According to another preferred alternative form of the invention, the pulverulent metallic filler is chosen from the group consisting of iron, iron alloys, mixtures of iron with another metal, iron compounds, barium compounds, such as barium sulphate, tungsten, mixtures of tungsten with another metal, tungsten alloys and tungsten compounds.

Mention may be made, as preferred examples of a tungsten-comprising filler, of tungsten, iron-tungsten mixtures, ferrotungsten alloys, tungsten-nickel-iron alloys, tungsten carbide, tungsten oxides and tungsten salts.

Mention may also be made of the W/Fe/Cr, W/Fe/Si, W/Ni/Cu and W/Ni/Co alloys.

According to a preferred alternative form, the pulverulent metallic filler represents between 30% and 70% by weight with respect to the composite material.

The particle size of the pulverulent metallic filler is preferably between 0.5 $\mu$m and 250 $\mu$m, better still between 0.5 $\mu$m and 100 $\mu$m. The range 1 $\mu$m–50 $\mu$m is particularly preferred. The polybutadiene chains

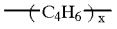

of the crosslinked polybutadiene preferably comprise pendant vinylic unsaturations, that is t say that they comprise —$C_4H_6$— units with the structure

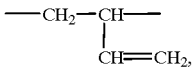

and ethylenic unsaturations in the chain which can be in the cis position or in the trans position, that is to say —$C_4$H6— units with the structure

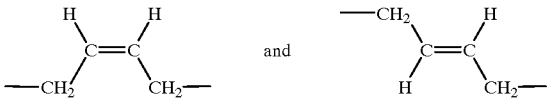

The polybutadiene chains preferably comprise between 15% and 25% of pendant vinylic unsaturations wish respect to the total number of the unsaturations.

Equally preferably, they also comprise between 50% and 60% of ethylenic unsaturations in the trans position and between 20% and 30% of ethylenic unsaturations in the cis position, with respect to the total number of the unsaturations.

The following description is to be considered in connection with the following drawings, in which.

As regards the shape of the novel non-lethal projectiles according to the invention, they can take any shape, namely any shape usual for this type of projectile, in particular spherical, cylindrical or ogival.

Figure 1:
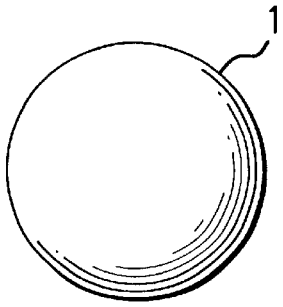
FIG. 1 is a side elevational view of a projectile according to the present invention.
Figure 2:
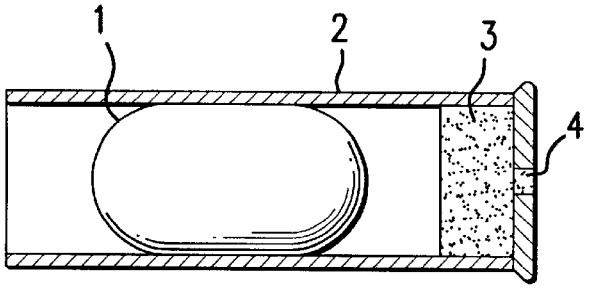
FIG. 2 is a cross sectional view of a cartridge according to the present invention.

As clearly seen in FIG. 1, the projectiles 1 according to the invention have, in the absence of any stress, a spherical shape and are intended to be forcibly inserted into cylindrical cartridges 2 devoid of wadding having an internal diameter which is less than the diameter of the projectile (as seen in FIG. 2), a single projectile being used per cartridge. Cartridge 2 also includes a powder propellant 3 and a primer cap 4.

The projectile, thus in place, then exhibits a cylindrical shape with rounded ends.

Equally preferably, the diameter of the bore of the barrel of the gun, generally a handgun, in which the abovementioned cartridges are used is also less than the diameter of the projectile, which itself ensures leaktightness with respect to combustion gases from the propellent powder.

Figure 3:
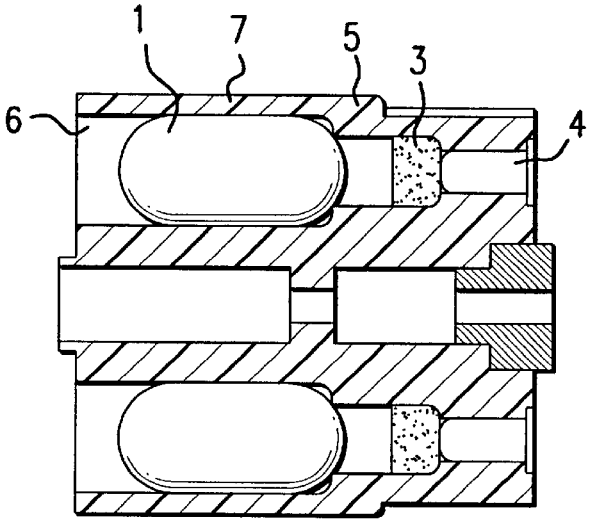
FIG. 3 is an axial cross sectional view of a monolith for holding several rounds of ammunition according to the present invention.

According to a particularly preferred alternative form of use which is rendered possible by virtue of the abovementioned specific properties and nature of the projectiles according to the invention, as clearly seen in FIG. 3 several cartridges, each comprising a forcibly inserted projectile 1, are housed in a monolith for holding rounds of ammunition composed of a plastic revolving magazine 5 designed to remain intact after each firing of a projectile and the gun can then be used as a repeater gun.

Revolving magazine 5 comprises six identical and parallel cylindrical chambers 6 uniformly distributed in a circle and adapted to each house a cartridge. Each chamber 6 includes a first wide bore 7 in which the deformed projectile 1 is lodged and a second bore in which is inserted the powder propellant 3 and finally the primer cap 4.

The cartridge comprises neither an individual outer casing nor wadding, which markedly reduces its cost.

Furthermore, the absence of cartridge case and of wadding makes it possible to avoid the ejection of additional projectiles and possible serious injuries which might result therefrom.

The revolving magazine behaves as a loaded and non-reloadable cylinder. After firing all the projectiles and then extracting the empty magazine, a fresh plastic revolving magazine provided with cartridges is engaged in the space in the body of the gun reserved for this purpose.

The abovementioned novel non-lethal projectiles according to the invention can be obtained according to a process comprising the following 4 successive stages:

a) a pasty thermosetting composition comprising:
   - a liquid polybutadiene comprising reactive functional ends, the number-average molecular mass (Mn) of the polybutadiene chain of which is between 500 and 10,000, preferably between 1000 and 5000,
   - a crosslinking agent for this polybutadiene,
   - a pulverulent metallic filler with a relative density of between 4 and 22, is first of all prepared by simple mixing of the various constituents, b) the pasty thermosetting composition thus obtained is introduced into a mould with the shape chosen for the projectile, for example by simple casting or by injection, c) the composition is subsequently crosslinked by heating, preferably at a temperature of between 60° C. and 150° C., d) the projectile obtained is then removed from the mould.

The physical state, pasty for the composition and liquid for the polybutadiene, must be assessed under standard conditions of temperature and pressure.

Furthermore, according to the invention, the liquid polybutadiene can also comprise non-terminal reactive functional groups, that is to say attached along the polybutadiene chain. These non-terminal reactive functional groups are preferably identical to the terminal functional groups.

In this case, a functionality of reactive functional groups of greater than 2 is obtained.

Of course, the mean random functionality measured may not be an integer, which is generally the case, because a polymer is only very rarely composed of identical molecules. It is, for example, between 2.0 and 2.5.

"Crosslinking" agent for the polybutadiene should be understood as meaning an agent capable of reacting with the reactive functional ends of the polybutadiene and, when they are present, with the non-terminal reactive functional groups, so as to establish bridges between the polybutadiene chains, to result in a solid crosslinked polybutadiene with a three-dimensional structure.

According to a preferred alternative form, the polybutadiene comprises hydroxyl functional ends and the crosslinking agent is a polyisocyanate, for example a diisocyanate, such as toluylene diisocyanate (mixture of the 2,4 and 2,6 isomers), 4,4'-diphenylmethane diisocyanate or isophorone diisocyanate, thus making it possible to form a crosslinked polyurethane network.

When the crosslinking agent is a diisocyanate, a polybutadiene with a hydroxyl functionality of greater than 2, for example of the order of 2.2, is used and/or a chain-extending polyol having a hydroxyl functionality of greater than 2, such as trimethylolpropane, is added to the thermosetting composition.

According to another alternative form, the polybutadiene comprises carboxyl functional ends and the crosslinking agent is a polyepoxide or a polyaziridine, thus making it possible to form a crosslinked ester-alcohol network or a crosslinked ester-amine network respectively.

Mention may be made, as examples of polyepoxides, of the various condensates of epichlorohydrin and of glycerol, which are mixtures of di- and triepoxides comprising chlorinated residues, and mention may be made, as examples of polyaziridines, of tris(2-methyl-1-aziridinyl)phosphine oxide (MAPO) and phenylbis(2-methyl-1-aziridinyl) phosphine oxide (phenylMAPO).

When the crosslinking agent is difunctional, use is made of a polybutadiene having a functionality of carboxyl functional groups of greater than 2.

According to another alternative form, the pasty thermosetting composition also comprises a plasticizing agent.

According to another alternative form, the pasty castable thermosetting composition also comprises an antioxidizing agent.

According to another alternative form, the pasty thermosetting composition also comprises a crosslinking catalyst which makes it possible to reduce the reaction time and/or temperature.

These catalysts are generally organic salts of transition metals, such as iron acetylacetonate, copper acetylacetonate, lead octoate, lead chromate and dibutyltin dilaurate.

According to another alternative form, the pasty thermosetting composition also comprises a chain-extending polyol, for example a diol, such as trimethylhexanediol, or a triol, such as trimethylol-propane.

According to the invention, the pasty thermosetting composition can be obtained, for example, by premixing the liquid polybutadiene with the pulverulent metallic filler in a kneader, optionally in the presence of the chain-extending polyol, plasticizer and antioxidant, at a temperature, for example, of between 30° C. and 80° C. and optionally at reduced pressure.

The optional catalyst is subsequently added, subsequently followed by the crosslinking agent for polybutadiene.

After mixing at a temperature, for example, of between 30° C. and 50° C. and preferably at reduced pressure, until a homogeneous paste is obtained, the latter is introduced into moulds with a shape chosen for the projectiles, for example into twin-shell moulds in order to obtain spherical projectiles.

The pasty thermosetting composition is subsequently crosslinked by heating at a temperature, for example, of between 60° C. and 150° C., preferably of between 90° C. and 120° C.

After cooling the mould, soft and elastic, crosslinked polymeric composite materials are obtained by removing from the mould, which materials can be used directly as non-lethal projectiles for a firearm.

Another subject-matter of the present invention is the abovementioned novel, soft and elastic, crosslinked polymeric composite materials, namely novel, soft and elastic, composite materials comprising a polymeric organic matrix and a pulverulent metallic filler dispersed in the polymeric matrix, characterized in that:

- the Shore A hardness of the composite material is between 2 and 30,
- the relative density of the composite material is between 1.0 and 2.9,
- the relative density of the metallic filler is between 4 and 22,
- the polymeric organic matrix is a crosslinked polybutadiene comprising polybutadiene chains connected by bridges, the number-average molecular mass of the polybutadiene chains being between 500 and 10,000.

The following non-limiting examples illustrate the invention and the advantages which it provides.

EXAMPLES 1 TO 4

Non-lethal projectiles for a firearm composed of a soft and elastic composite material comprising iron powder as filler.

EXAMPLE 1

A pasty castable thermosetting composition is prepared by mixing the various constituents in a 1 litre glass reactor, the composition having the following composition by mass:

| | |
|---|---|
| polybutadiene comprising hydroxyl ends, with a mass Mn of approximately 2300 and a hydroxyl functionality in the region of 2.2 (i.e. a mass Mn of the polybutadiene chain of approximately 2263), comprising 20% of pendant vinylic unsaturations, 25% of ethylenic unsaturations in the chain in the cis position and 55% of ethylenic unsaturations in the chain in the trans position | 100.0 g |
| short chain-extending alcohol: trimethylhexanediol (TMHD) | 11.3 g |
| plasticizer: dioctyl azelate (DOZ) | 61.6 g |
| antioxidant: di-tert-butyl-para-cresol (DBPC) | 1.0 g |
| pulverulent metallic filler: iron powder with a particle size of approximately 50 $\mu$m | 120.4 g |
| crosslinking catalyst: dibutyltin dilaurate (DBTL) | 1.7 g |
| crosslinking agent: mixture of the 2,4 and 2,6 isomers of toluylene diisocyanate (Dis-T or TDI or Desmodur T) | 18.2 g |

To prepare this mixture, a premix of the short alcohol, plasticizer and antioxidant is first of all prepared and then the polybutadiene comprising hydroxyl ends and the pulverulent metallic filler are added.

This premix is stirred and homogenized by heating at 60° C. for 4 h under a reduced pressure of approximately 10 mm Hg. After cooling to ambient temperature and returning to atmospheric pressure, the crosslinking catalyst is added while stirring the mixture for approximately 2 min at 25° C.

The crosslinking agent is subsequently added and then mixing is carried out at 40° C. for approximately 10 min under a reduced pressure of approximately 10 mm Hg.

The pasty thermosetting composition then obtained is subsequently cast in the 2 parts of a preheated twin-shell mould having the general shape of a sphere with a diameter of 13 mm.

After precuring for approximately 2 h at ambient temperature, the mould is closed and then the composition present in the mould is subsequently crosslinked by heating for 6 h at 110° C.

After cooling the mould to ambient temperature and then opening, a ball made of soft and elastic composite material, with a diameter of 13 mm and a mass of approximately 1.68 g, is removed from the mould, which ball can be used directly, after possible deflashing at the parting line, as non-lethal projectile for a firearm.

The use of several moulds made it possible to obtain several balls.

The relative density of the composite material constituting these balls, determined according to the immersion method, is 1.4 and its Shore A hardness, determined according to ASTM Standard D 2240, is 22.

These projectiles were fired from a rifle with a shortened barrel with an internal diameter of 13 mm and a length of 65 mm, the mass of propellent powder (0.32 g of AS24 powder) being adjusted in order to obtain an impact energy in the region of 40 joules (speed of the projectile measured at 5 m from the muzzle of the rifle in the region of 220 m/s).

The projectiles impact at 5 m on two types of materials:

a block of soft plasticine No. 40 at 20° C., a block of gelatin, prepared at 20%, at 10° C.

For each test, the minimum and maximum dimensions of the impression, as well as its depth, are recorded.

Furthermore, the impact of the projectile on the block is displayed by high-speed cinematography.

The mean results obtained on firing 10 times at plasticine blocks and 10 times at gelatin blocks are as follows:

the mean dimensions of the impacts on plasticine (circular or with slight oval shapes) are of the order of 30 mm in breadth and 11 mm in depth, the dimensions of the tears are of the order of 25 mm in the gelatin for a depth of impression of 15 to 20 mm, all the impacts fit into a disc with a diameter of 150 mm, the aiming centre being the centre of this disc, by studying the films, it is observed that the projectile, before impact, is deformed and is subject to elongation. Its dimensions are approximately 9–10 mm×15–16 mm. On impacting on the block, the projectile flattens with the formation of a pancake. After impacting on the plasticine block, the projectile rebounds and very quickly resumes its initial shape and dimensions, whereas it penetrates into the gelatin block and remains trapped therein.

EXAMPLES 2 TO 4

Example 1 is repeated exactly, with the exception of the following sole modifications:

71.7 g of DOZ are used as plasticizer, instead of 61.6 g, 325.9 g of iron powder are used as filler for Example 2, 390.3 g for Example 3 and 463.0 g for Example 4.

The relative density of the composite material constituting the balls obtained is 2.10 for Example 2, 2.23 for Example 3 and 2.42 for Example 4.

The Shore A hardness is 15 for Example 2 and 23 for Examples 3 and 4.

The impact on plasticine is approximately 27 mm in diameter and 14 mm in depth for Example 2 and approximately 23 mm in diameter and 11 mm in depth for Examples 3 and 4.

EXAMPLE 5

Non-lethal projectiles for a firearm composed of a soft and elastic composite material comprising barium sulphate powder as filler.

Example 1 is repeated exactly, with the exception of the following sole modifications:

13.2 g (instead of 11.3 g) of TMHD are used as chain extender, 71.7 g (instead of 61.6 g) of DOZ are used as plasticizer, 21.2 g (instead of 18.2 g) of TDI are used as crosslinking agent, no crosslinking catalyst was used, 425 g of barium sulphate powder with a particle size of approximately 10 μm (instead of 120.4 g of iron powder) are used as filler.

The relative density of the composite material constituting the balls obtained is 2.0 and its Shore A hardness is 17.

The impact on plasticine is approximately 29 mm in diameter and 11 mm in depth.

EXAMPLE 6

Non-lethal projectiles for a firearm composed of a soft and elastic composite material comprising a tungsten-based alloy powder as filler.

Example 5 is repeated exactly, with the exception of the following sole modifications:

0.4 g of DBTL is used as crosslinking catalyst, 228.2 g of a W/Ni/Fe (92/5/3 respectively by weight) alloy powder, with a particle size of 5–10 μm and a relative density of 19 (instead of 425 g of barium sulphate), are used as filler, the pasty thermosetting composition is not cast in the 2 parts of a twin-shell mould but injected into the mould.

The composition is subsequently crosslinked by heating at 110° C. for 4 h (instead of 6 h for Example 5).

The projectiles obtained have a mass of approximately 2.10 g. They exhibit a relative density of 1.90 and a Shore A hardness of 16.

Three monoliths for holding rounds of ammunition for a handgun of pistol type were subsequently prepared, these monoliths being composed of a cylindrical revolving magazine made of rigid and non-deformable plastic having a front circular face and a rear circular face. This magazine has the external appearance of a cylinder and has six cylindrical chambers, the axes of which are parallel to its axis of rotation.

The said chambers cut right through the monolithic component and are arranged so that their circular cross-sections are evenly spaced around a circle.

Each chamber exhibits a first bored cavity with a diameter of 9.5 mm, into which is inserted the abovementioned deformable projectile with a diameter of 13 mm, and a second bored cavity with a diameter of 7 mm, into which are introduced the powder charge used for the propulsion of the projectile and a cap.

The propellent powder is composed of 0.05 g of a fine nitrocellulose single base powder manufactured by SNPE and the cap is a central percussion cap for a cartridge with a calibre of 12 mm.

The deformable projectile, which in the absence of any stress exhibits a spherical shape with a diameter of 13 mm, acquires, in the monolith for holding rounds of ammunition, a substantially cylindrical shape with two rounded ends.

These monoliths for holding rounds of ammunition were prepared by first of all inserting the projectiles, then charging the propellent powder and then, finally, inserting the caps.

The projectiles of one of the 3 monoliths for holding rounds of ammunition were fired using a metallic launching device, the internal dimensions of the chamber and barrel of which correspond to those of a pistol.

The speed of the projectiles, measured at: 2.7 m from the muzzle of the barrel using optical barriers, is 150 m/s.

The impact of the projectile on a plasticine target at 2.7 m from the muzzle of the barrel was displayed by high-speed cinematography. It is found that the projectiles flatten, taking the shape of a pancake with a diameter of approximately 35 mm.

The second monolith for holding rounds of ammunition was stored for 15 days and then the projectiles were mechanically extracted. The projectiles immediately return to their initial spherical shape (diameter of 13 mm). The projectiles according to the invention have a notable shape memory when they are subjected to mechanical stresses.

Spherical projectiles with an identical diameter of 13 mm comprising a thermoplastic elastomeric matrix of EPDM type or of styrene-isoprene-styrene type, stored for 15 days under mechanical stress under the same conditions, do not return to their original spherical shape and remain oval in shape.

The third monolith for holding rounds of ammunition was inserted into a suitable handgun and then the projectiles were fired at pigs from a distance of 3 m, various parts of the body, in particular the pleural-pulmonary, cardiac, hepatic and abdominal regions, being targeted. Only cutaneous erosions accompanied by slight ecchymoses, generally restricted to the external face of the skin, were observed. No serious injury, in particular internal injury, was revealed. No injury other than those affecting the surface anatomy and of a subclinical nature could be detected clinically.

What is claimed is:

1. Non-lethal projectile for a firearm composed of a soft and elastic composite material comprising a polymeric organic matrix and a pulverulent metallic filler dispersed in the polymeric matrix, characterized in that:

the Shore A hardness of the composite material is between 2 and 30, the relative density of the composite material is between 1.0 and 2.9, the relative density of the metallic filler is between 4 and 22, the polymeric organic matrix is a crosslinked polybutadiene comprising polybutadiene chains connected by bridges, the number-average molecular mass of the polybutadiene chains being between 500 and 10,000.

2. Non-lethal projectile according to claim 1, characterized in that the crosslinked polybutadiene is a polyurethane.

3. Non-lethal projectile according to claim 1, characterized in that the crosslinked polybutadiene is plasticized.

4. Non-lethal projectile according to claim 1, characterized in that the crosslinked polybutadiene comprises one or more antioxidizing agents.

5. Non-lethal projectile according to claim 1, characterized in that the Shore A hardness of the composite material is between 10 and 25.

6. Non-lethal projectile according to claim 1, characterized in that the relative density of the composite material is between 1.5 and 2.5.

7. Non-lethal projectile according to claim 1, characterized in that it exhibits a spherical shape.

8. Non-lethal projectile according to claim 1, characterized in that the pulverulent metallic filler represents between 30% and 70% by weight with respect to the composite material.

9. Non-lethal projectile according to claim 1, characterized in that the pulverulent metallic filler is chosen from the group consisting of iron, iron alloys, mixtures of iron with another metal, iron compounds, barium compounds, tungsten, mixtures of tungsten with another metal, tungsten alloys and tungsten compounds.

10. Non-lethal projectile according to claim 1, characterized in that the polybutadiene chains have a number-average molecular mass of between 1000 and 5000.

11. Process for producing a non-lethal projectile according to claim 1, characterized in that:

a) a pasty thermosetting composition comprising:
   a liquid polybutadiene comprising reactive functional ends, the number-average molecular mass of the polybutadiene chain of which is between 500 and 10,000,
   a crosslinking agent for this polybutadiene,
   a pulverulent metallic filler with a relative density of between 4 and 22, is prepared by mixing of the constituents, b) the pasty thermosetting composition thus obtained is introduced into a mould with the shape chosen for the projectile, c) the composition is subsequently crosslinked by heating, d) the projectile obtained is then removed from the mould.

12. Process according to claim 11, characterized in that the liquid polybutadiene also comprises non-terminal reactive functional groups.

13. Process according to claim 11, characterized in that the reactive functional ends are hydroxyl functional groups and in that the crosslinking agent is a polyisocyanate.

14. Process according to claim 13, characterized in that the composition also comprises a chain-extending polyol.

15. Process according to claim 11, characterized in that the reactive functional ends are carboxyl functional groups and in that the crosslinking agent is a polyepoxide or a polyaziridine.

16. Process according to claim 11, characterized in that the composition also comprises at least one compound chosen from the group consisting of plasticizing compounds, antioxidizing compounds and crosslinking catalyst compounds.

17. Process according to claim 11, characterized in that the composition is crosslinked by heating at a temperature of between 60° C. and 150° C.

18. Soft and elastic composite material comprising a polymeric organic matrix and a pulverulent metallic filler dispersed in the polymeric matrix, characterized in that:

the Shore A hardness of the composite material is between 2 and 30, the relative density of the composite material is between 1.0 and 2.9, the relative density of the metallic filler is between 4 and 22, the polymeric organic matrix is a crosslinked polybutadiene comprising polybutadiene chains connected by bridges, the number-average molecular mass of the polybutadiene chains being between 500 and 10,000.

19. Cylindrical cartridge for a firearm, characterized in that it comprises at least one non-lethal projectile in accordance with one of claim 1.

20. Cylindrical cartridge according to claim 19, characterized in that the internal diameter of the cartridge is less than the diameter of the projectile.

21. Cartridge according to claim 20, characterized in that its external wall is composed of at least one bored cavity of a revolving magazine constituting a monolith for holding rounds of ammunition.

* * * * *